US007355346B1

(12) United States Patent
Chen et al.

(10) Patent No.: US 7,355,346 B1
(45) Date of Patent: Apr. 8, 2008

(54) LIGHTING DEVICE USING HIGH INTENSITY DISCHARGE

(75) Inventors: Lung Chen, Hsin-Chu County (TW); Hui-Hsiang Feng, Hsin-Chu County (TW); Ya-Chuan Yeh, Hsin-Chu County (TW)

(73) Assignee: Arclite Optronics Corporation, Hsin Chu County (TW)

( * ) Notice: Subject to any disclaimer, the term of this patent is extended or adjusted under 35 U.S.C. 154(b) by 0 days.

(21) Appl. No.: 11/751,642

(22) Filed: May 22, 2007

(51) Int. Cl.
*H01J 61/04* (2006.01)

(52) U.S. Cl. ..... 313/607; 313/594; 313/234

(58) Field of Classification Search ..... 313/607, 313/594, 234
See application file for complete search history.

(56) References Cited

U.S. PATENT DOCUMENTS 6,198,223 B1 * 3/2001 Scholz ..... 313/623
6,727,649 B1 * 4/2004 Yano et al. ..... 313/607
6,995,513 B2 * 2/2006 Alderman et al. ..... 313/607

* cited by examiner

*Primary Examiner*—Ashok Patel
(74) *Attorney, Agent, or Firm*—Leong C. Lei

(57) ABSTRACT

The lighting device contains a quartz tube and a UV production member. In addition to a main chamber for high intensity discharge, the quartz tube has an auxiliary chamber formed around the conductor in a first end section. The UV production member contains a probe and a coil surrounding the first end section. An end of the coil is connected to a conducting wire from the other end section of the quartz tube. The other end of the coil is connected to the probe whose tip penetrates through the first end section of the quartz tube into the auxiliary chamber and points to the main chamber. When a voltage is applied, electrons are shot from the tip of the probe into the gas in the auxiliary chamber, and UV light is thereby produced and directed into the main chamber for the enhanced activation of the lighting device.

4 Claims, 4 Drawing Sheets

LIGHTING DEVICE USING HIGH INTENSITY DISCHARGE

(a) TECHNICAL FIELD OF THE INVENTION

The present invention generally relates to lighting devices, and more particularly to a light device producing light through high intensity discharge.

(b) DESCRIPTION OF THE PRIOR ART

Most projectors use a high intensity discharge (HID) light bulbs as they are able to produce the required brightness and color temperature, as well as a spectrum covering the entire visible light.

FIG. 4 is a schematic diagram showing the structure of a conventional HID light bulb. As illustrated, the light bulb contains a quartz tube 3 which in turn contains a chamber 31 in the center between two opposing end sections 33. The chamber 31 is filled with a gas capable of ionization. Two opposing electrodes 32 are extended into the chamber 31 from two foil-like connectors 34 sealed inside the two end sections 33 of the quartz tube 3, respectively. Two conducting wires 35 are then connected to the two conductors 34 for the application of voltage. The quartz tube 3 is usually fixedly supported inside a reflective dome 36.

For people skilled in the HID technology, it is well known that the gas density is related to the activation speed of the light bulb and that, under a specific gas density, the activation of the light bulb is enhanced if an appropriate amount of ultra-violet (UV) light is introduced into the chamber. In addition, as the light bulb would reach an extremely high temperature, heat dissipation by fan is a mostly common means to prevent the accumulated heat from damaging the light bulb and related parts. However, it is also well known that, if the heat dissipation is not conducted properly, the quartz tube could explode from the stress developed during the cooling process.

The Republic of China, Taiwan, Patent Publication No. 200407395 teaches an UV-enhanced HID light bulb, which provides a small airtight chamber, also filled with gas capable of ionization, in each of the two end sections where the two conductors are embedded. UV light is produced by the electrons shot into the airtight chamber from the conductor's edge. As the airtight chambers are provided adjacent to the edges of the conductors, the technique suffers that insufficient amount of UV light is produced from the limited space of the airtight chambers. Additionally, the technique still suffers the problem that the quartz tube might explode during the cooling process.

SUMMARY OF THE INVENTION

Accordingly, a novel HID-based lighting device is provided herein, which not only has enhanced activation but also is less susceptible to the explosion during the cooling process.

A major objective of the present invention is to provide a means to offer an appropriate amount of UV light for enhanced activation, as well as a buffering effect to prevent the stress-caused explosion during the cooling process.

To achieve the above objective, the lighting device contains a quartz tube and a UV production member. The quartz tube is similar to a conventional one in that a main chamber is positioned between two opposing end sections, and two electrodes are extended into the main chamber from two conductors embedded in the two end sections, respectively.

The present invention differs in that, in a first end section of the quartz tube, an auxiliary chamber is formed around or along the conductor.

The UV production member contains a probe and a coil surrounding the first end section. An end of the coil is connected to the conducting wire from the other end section of the quartz tube. The other end of the coil is connected to the probe. The tip of the probe penetrates through the first end section of the quartz tube into the auxiliary chamber and points to the main chamber. When a voltage is applied, electrons are shot from the tip of the probe into the gas in the auxiliary chamber, and UV light is thereby produced and directed into the main chamber for the enhanced activation of the lighting device.

The auxiliary chamber is around or along the conductor and has a larger space than the prior arts. An appropriate amount of UV light is therefore produced. The auxiliary chamber also provides a buffering effect for the quartz tube to the outside cool air so as to lessen the impact of stress developed during the cooling process.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
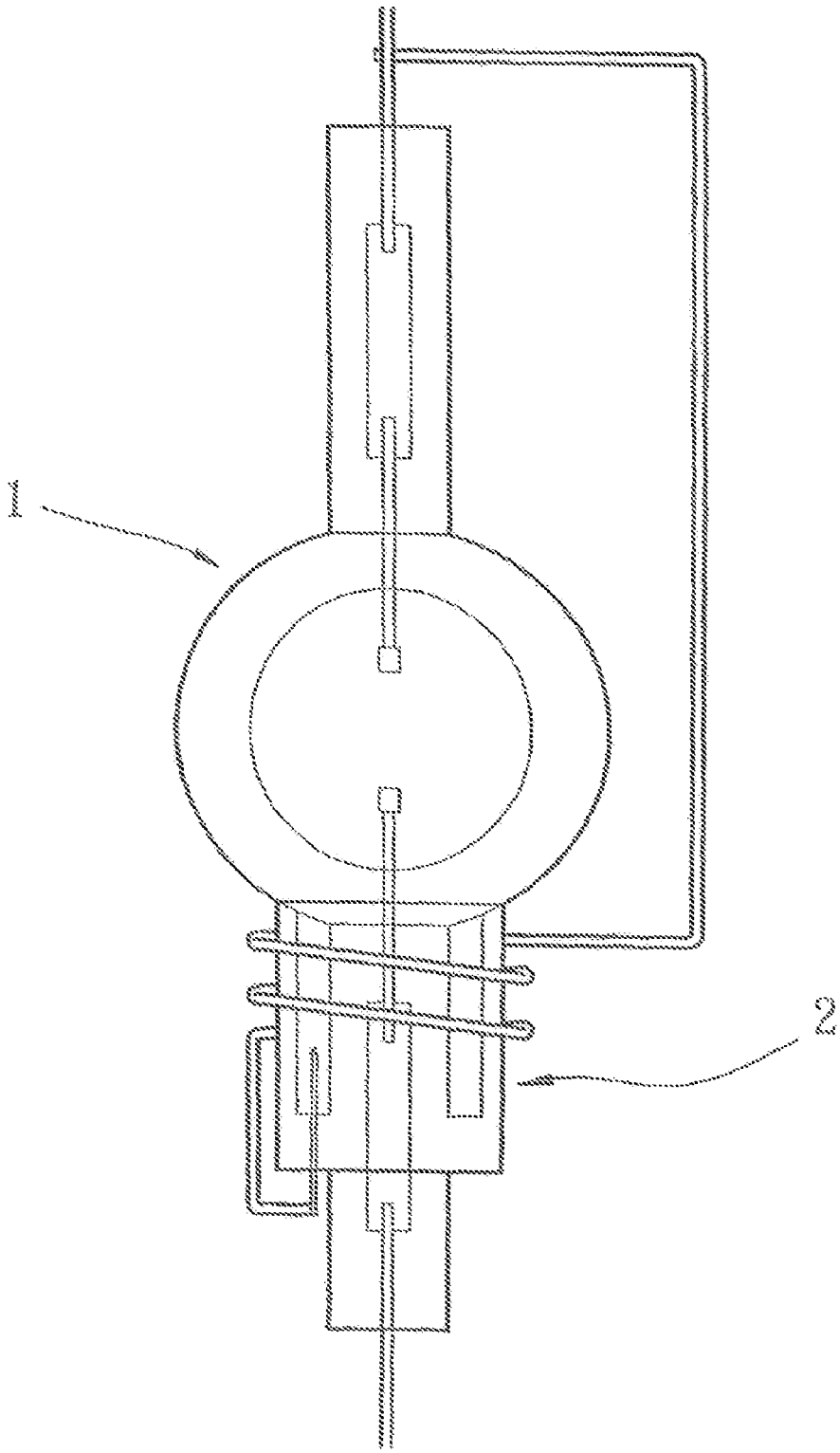
FIG. 1 is a schematic diagram showing a lighting device according to an embodiment of the present invention.
Figure 2:
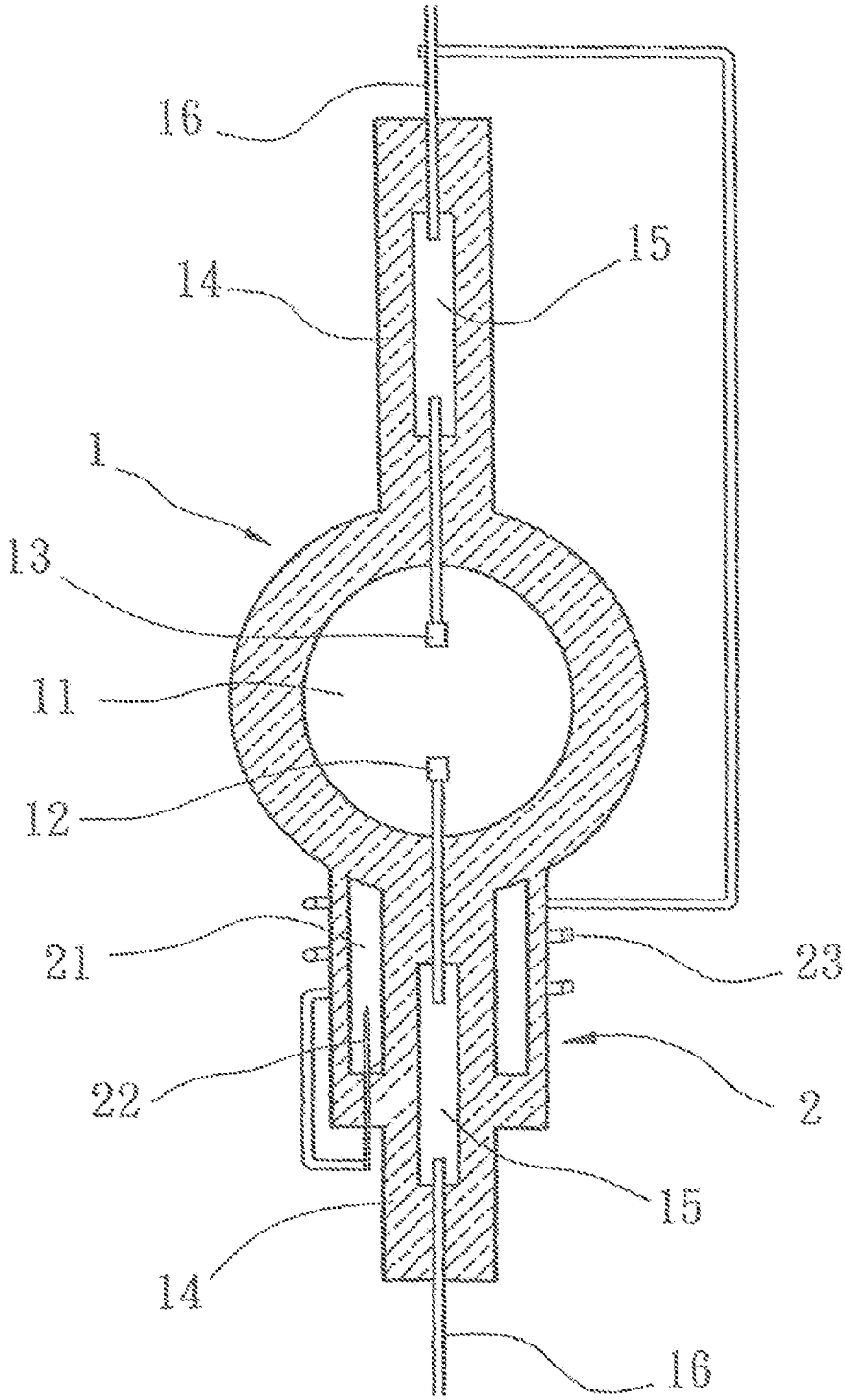
FIG. 2 is a sectional diagram showing the lighting device of FIG. 1.

As shown in FIGS. 1 and 2, an embodiment of the present invention contains a quartz tube 1 and an UV production member 2. The quartz tube 1 contains a main chamber 11 between two end sections 14. The main chamber 11 is filled with a gas capable of ionization. Two electrodes 12 and 13 are extended into the main chamber 11 from two foil-like connectors 15 sealed inside the two end sections 14 of the quartz tube 1, respectively. Two conducting wires 16 are then connected to the two conductors 15 for the application of voltage. Inside a first end section 14 of the quartz tube 1, an auxiliary chamber 21 full of a gas capable of ionization is formed around or along (but not touching) the conductor 15 there.

The UV production member 2 contains a metallic probe 22 and a metallic coil 23. The probe 22 has its tip penetrating through the first end section 14 into the auxiliary chamber 21 and pointing toward the main chamber 11 of the quartz tube 1. The other end of the probe 22 is connected to an end of the coil 23 which surrounds the first end section 14. The other end of the coil 23 is connected to the conducting wire 16 of the other end section 14 of the quartz tube 1.

When a voltage is applied to the conducting wires 16, UV light is produced due to the electric field provided by the coil 23 and the electrons shot into the auxiliary chamber 21 from the tip of the probe 22. The activation of the lighting device is therefore enhanced as the UV light enters the main chamber 11. The auxiliary chamber 21 is able to provide a buffering effect for the extremely hot quartz tube 1 to the outside cool air. The quartz tube 1 is therefore less susceptible to the stress-caused explosion during the cooling process.

The auxiliary chamber 21, as it is formed around or along the conductor 15, has a larger space than the prior arts and therefore contains more gas. An appropriate amount of UV is thereby produced for the main chamber 11. The auxiliary chamber 21 is formed during the fabrication of the quartz tube 1 and this can be easily achieved using the current technology and equipment. The size of the auxiliary chamber 21 can be adjusted in accordance with the application requirement.

Figure 3:
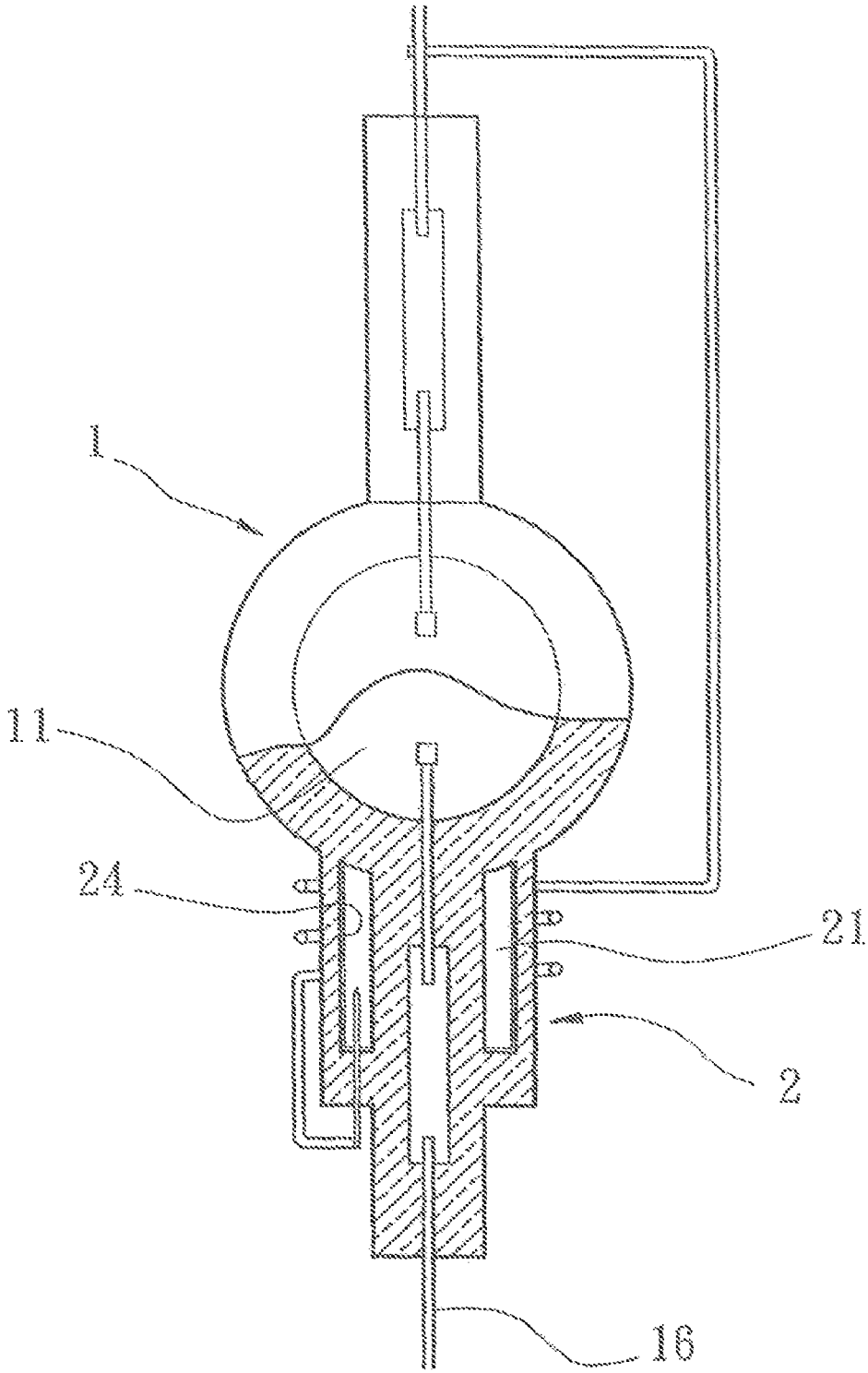
FIG. 3 is a schematic diagram showing a lighting device according to another embodiment of the present invention.
Figure 4:
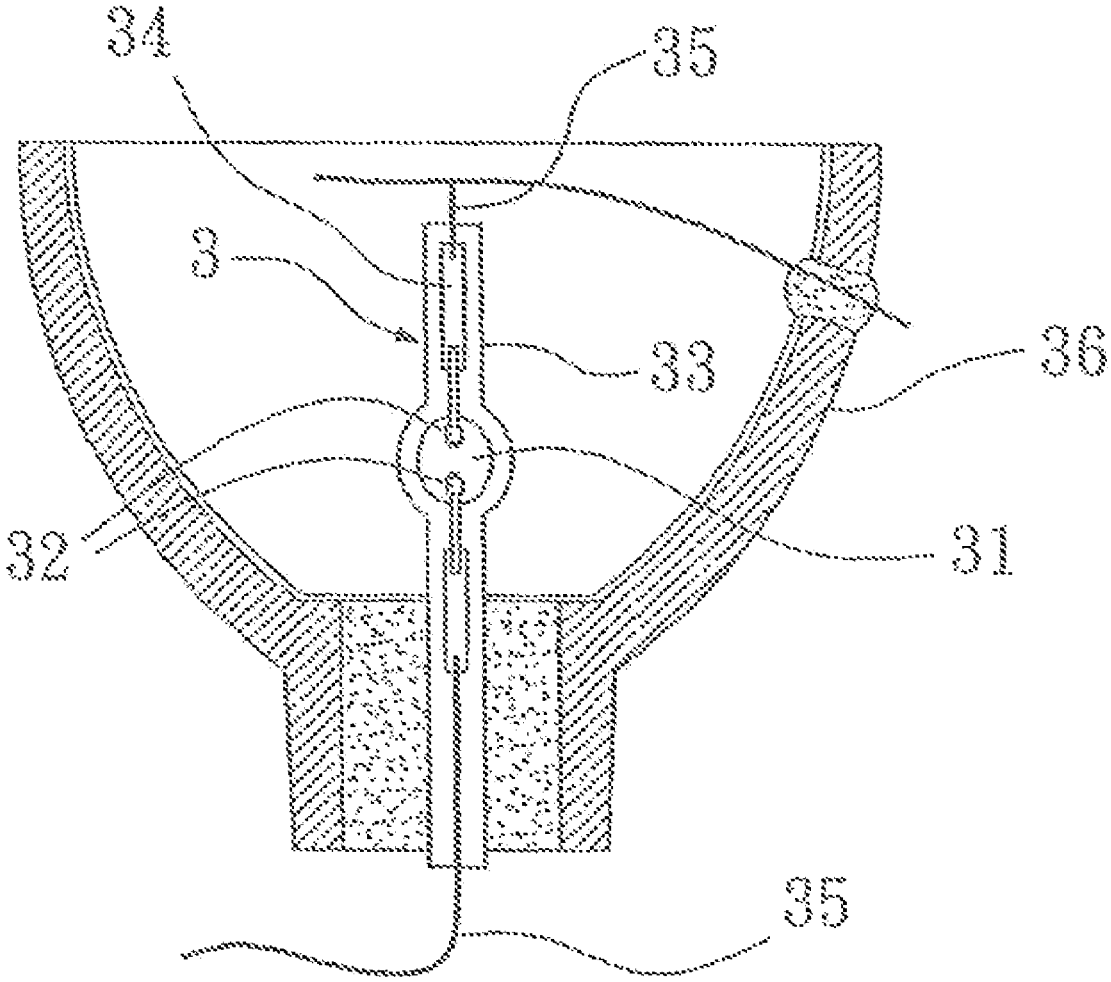
PRIOR ART FIG. 4
FIG. 4 is a schematic diagram showing the structure of a conventional HID light bulb.

In another embodiment of the present invention shown in FIG. 3, a reflective layer 24 is fixedly provided by plating, painting, or printing on the inside or outside of the walls of the auxiliary chamber 21, except those walls adjacent to the main chamber 11. As such, the UV light produced from the auxiliary chamber 21 is more effectively directed to the main chamber 11.

In an embodiment of the present invention, the probe 22 is made of molybdenum (Mo) and the auxiliary chamber 21 is filled with a mix of argon (Ar) and mercury (Hg). In other embodiments, a single inert gas such as helium, neon (Ne), argon (Ar), krypton (Kr), xenon (Xe), radon (Rn).

The major characteristic of the present invention is in the provision of the auxiliary chamber which not only is used to produce UV light for the enhancement of the lighting device's activation, but also provides a buffering effect to prevent the lighting device from explosion during the cooling process.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. A lighting device using high intensity discharge comprising:

a quartz tube having a main chamber filled with a gas capable of ionization between a first end section and a second end section, two electrodes extended into said main chamber from two conductors embedded in said first and second end sections, respectively, two conducting wires extended from said two conductors to the outside of said first and second end sections, respectively, and an auxiliary chamber filled with a gas capable of ionization formed inside said first end section along or around said conductor; and an UV production member having a probe and a coil surrounding said first end section, an end of said coil connected to said conducting wire extended from said second end section, the other end of said coil connected to said probe, the tip of said probe penetrating through said first end section into said auxiliary chamber and pointing to said main chamber.

2. The lighting device according to claim 1, wherein said gas in said auxiliary chamber is an inert gas.

3. The lighting device according to claim 1, wherein said gas in said auxiliary chamber is a mix of argon (Ar) and mercury (Hg).

4. The lighting device according to claim 1, wherein a reflective layer is provided on the walls of said auxiliary chamber.

* * * * *